US005988278A

United States Patent [19]

Johnson

[11] Patent Number: 5,988,278

[45] Date of Patent: Nov. 23, 1999

[54] USING A HORIZONTAL CIRCULAR WELLBORE TO IMPROVE OIL RECOVERY

[75] Inventor: Mark O. Johnson, Anchorage, Ak.

[73] Assignee: Atlantic Richfield Company, Los Angeles, Calif.

[21] Appl. No.: 08/982,574

[22] Filed: Dec. 2, 1997

[51] Int. Cl.[6] ..... E21B 43/30

[52] U.S. Cl. ..... 166/245; 166/269; 166/272.7

[58] Field of Search ..... 166/245, 244.1, 166/268, 272.6, 272.7, 269, 305.1

[56] References Cited

U.S. PATENT DOCUMENTS

| | | | |
|---|---|---|---|
| 3,762,474 | 10/1973 | Allen et al. | 166/250 |
| 4,022,278 | 5/1977 | Allen | 166/269 |
| 4,205,723 | 6/1980 | Clauset, Jr. | 166/294 |
| 4,560,003 | 12/1985 | McMillen et al. | 166/305.1 |
| 4,834,179 | 5/1989 | Kokolis et al. | 166/268 |
| 5,083,610 | 1/1992 | Sheehy | 166/246 |
| 5,190,105 | 3/1993 | D'Souza | 166/303 |
| 5,193,617 | 3/1993 | D'Souza | 166/263 |
| 5,246,072 | 9/1993 | Frazier, Jr. et al. | 166/273 |
| 5,339,900 | 8/1994 | Clough | 166/274 |
| 5,339,904 | 8/1994 | Jennings, Jr. et al. | 166/303 |
| 5,363,915 | 11/1994 | Marquis et al. | 166/274 |
| 5,381,863 | 1/1995 | Wehner | 166/263 |
| 5,472,049 | 12/1995 | Chaffee et al. | 166/308 X |
| 5,503,226 | 4/1996 | Wadleigh | 166/252.1 |
| 5,720,350 | 2/1998 | McGuire | 166/305.1 |
| 5,826,656 | 10/1998 | McGuire | 166/305.1 |

*Primary Examiner*—Roger Schoeppel
*Attorney, Agent, or Firm*—F. Lindsey Scott

[57] ABSTRACT

A method for increasing the recovery of oil from a subterranean formation having at least one producer wellbore drilled therein, whereby a generally horizontal and generally circular wellbore is drilled so that oil is located between the generally horizontal and generally circular wellbore and the at least one producer wellbore. Fluid is injected through the generally horizontal and generally circular wellbore into the formation so that oil is swept to the at least one producer wellbore for recovery through the at least one producer wellbore.

20 Claims, 6 Drawing Sheets

USING A HORIZONTAL CIRCULAR WELLBORE TO IMPROVE OIL RECOVERY

BACKGROUND OF THE INVENTION

1. Field of the Invention

The invention relates generally to the recovery of hydrocarbon reserves from a subterranean formation and, more particularly, to using a horizontal circular wellbore to improve the recovery of oil from a plurality of producer wellbores drilled into a subterranean formation.

2. Brief Description of Prior Art

In the production of oil from subterranean formations, the oil may be produced initially by allowing the oil to flow, as a result of the oil-bearing formation's natural pressure, to the surface through wellbores extending from the surface into the subterranean oil-bearing formation, without the use of pumps or the like. After the formation pressure has dropped to a value less than that required to cause fluids to flow to the surface at a satisfactory rate, pumps, gas lifts, and other devices are used to move fluids from the formation to the surface. This phase of production, which is referred to as primary production, is often practiced with wellbores drilled in a "nine-spot" pattern 10 as shown in the plan view of FIG. 1, depicting the prior art. The "nine-spot" pattern 10 includes an array of eight producer wellbores 12, 14, 16, 18, 22, 24, 26, and 28 drilled into a subterranean formation (not shown in FIG. 1) to a form a perimeter of wellbores which surround a central wellbore 20. The arrows 30 indicate the direction of flow of oil from the formation into the wellbores during primary production.

After the oil flow from the formation has become insufficient to justify continued primary production using devices such as pumps and gas lifts to remove fluids from the formation directly, the primary production is discontinued and enhanced oil recovery processes are used. Enhanced recovery of the oil can be achieved by a variety of techniques which will vary widely depending upon the particular formation of interest. Three such techniques commonly used are water flooding, gas flooding, and combinations of water and gas flooding, referred to as "WAG" flooding.

In water flooding, water, such as brine or filtered seawater, is injected as a wave of fluid into the oil-bearing formation and pushed from a water injection wellbore toward an oil production well. In the nine-spot pattern 10, shown in FIG. 2, water is injected through the central wellbore 20 into the formation and pushed outwardly in the direction of the arrows 32 toward the perimeter wellbores 12, 14, 16, 18, 24, 26, and 28. Initially, oil and, subsequently, oil and injected water, are recovered from the production wells. Additional quantities of oil can be recovered from many formations by water flooding.

Gas flooding has also been used alone or in combination with water flooding to recover additional quantities of oil from formations. The gas typically comprises an oil miscible solvent such as hydrocarbons containing from one to about five carbon atoms, carbon dioxide, nitrogen, and mixtures thereof and is injected from an injection wellbore across the depth of the oil-bearing formation to form an injection wave of gas passing through the oil-bearing formation toward a production well. The gas may be single contact or multi-contact miscible with the oil, as well known to those skilled in the art. In the nine-spot pattern 10, shown in FIG. 2, gas is injected through the central wellbore 20 into the formation and pushed outwardly in the direction of the arrows 32 toward the perimeter wellbores 12, 14, 16, 22, 24, 26, and 28.

FIG. 3, an elevation view of the nine-spot pattern 10 taken along the line3—3 of FIG. 2, shows the flow patterns of the foregoing water flooding and as flooding. In FIG. 3, the oil-bearing formation is designated by the reference numeral 40, and includes an overburden 42, which formation and overburden are shown penetrated by the central wellbore 20 and the perimeter wellbores 18 and 22. In operation, water is injected via the wellbore 20 into the formation 40 and, because water is heavier than oil, the water tends to "slump" in the formation, particularly if the formation is thick and highly permeable with good vertical communication. As a result, the water flows downwardly and outwardly through a flow path 44 in the formation 40 toward the perimeter wellbores 18 and 22. Gas can be alternated with water in a WAG process and injected via the wellbore 20 into the formation 40 and, because the gas is generally lighter than the water and the oil in the formation, the gas tends to rise in the formation, particularly if the formation has good vertical communication. As a result, the gas flows upwardly and outwardly through a flow path 46 in the formation 40 toward the perimeter wellbores 18 and 22. Oil in the flow paths 44 and 46 will be swept into the perimeter wellbores 18 and 22, but maximum oil recovery from the formation 40 is not achieved.

Because the flow path 44 of water is downwardly, and the flow path 46 of gas is upwardly, a region 50 is formed between the flow paths 44 and 46 adjacent to the perimeter wellbores 18 and 22, as well as each of the other perimeter wellbores 12, 14, 16, 24, 26, and 28, and other areas of the formation, through which little or no injected water or injected gas flows. It can be appreciated that, as a result, a drawback with the foregoing water flooding and gas flooding techniques is that additional oil is not recovered in the regions 50. Additionally, a sub-optimal water sweep occurs in the upper flow path 46 and a sub-optimal gas sweep occurs in the lower flow path 44, which leaves recoverable oil in these areas also.

A further drawback with the prior art is that relatively high pressure must be used to inject water and gas from the injector wellbore 20 into the formation 40 so that, as the water and gas disperse toward each of the perimeter wellbores, the pressure will not be dissipated below the pressure necessary to sweep oil to each of the perimeter wellbores.

Therefore, what is needed is a method and system for recovering oil in the flow paths 44 and 46 and in the region 50 which is not fully recovered by conventional water flooding, gas flooding, or WAG processes.

SUMMARY OF THE INVENTION

According to the present invention, the recovery of oil from a subterranean formation having at least one producer wellbore drilled therein is improved by a method comprising drilling a generally horizontal and generally circular wellbore so that oil is located between the generally horizontal and generally circular wellbore and the at least one producer wellbore, and then injecting fluid through the generally horizontal and generally circular wellbore into the formation so that oil is swept to the at least one producer wellbore for recovery through the at least one producer wellbore.

DETAILED DESCRIPTION

In the discussion of the Figures, the same numbers will be used throughout to refer to the same or similar components. Not all pipes, pumps, valves, and the like necessary to achieve the desired flows have been shown.

Figure 4:
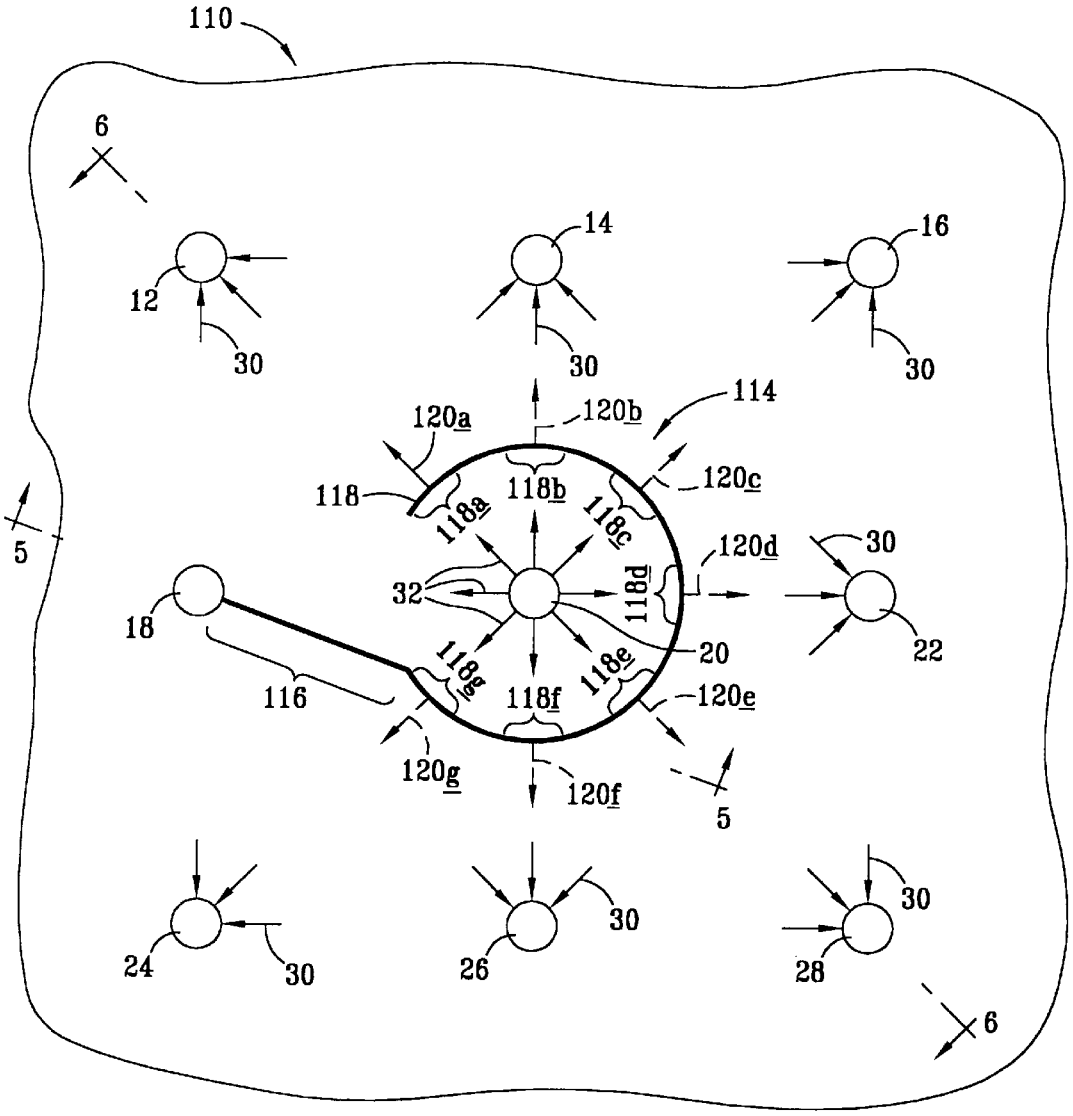
FIG. 4 is a plan view of the array of wellbores of FIG. 1 configured for recovering additional oil reserves according to the present invention.

With reference to FIG. 4 of the drawings, the reference numeral 110 generally designates a system, similar to the system 10 described above, having an array of nine wellbores 12, 14, 16, 18, 20, 22, 24, 26, and 28 drilled into a subterranean formation (not shown in FIG. 4) in a grid pattern. The arrows 32 indicate the direction of flow of enhanced recovery fluids such as water, gas, or water and gas in a WAG process from the central wellbore 20, and the arrows 30 indicate the direction of flow of oil from the formation into seven perimeter producer wellbores 12, 14, 16, 22, 24, 26, and 28.

Figure 5:
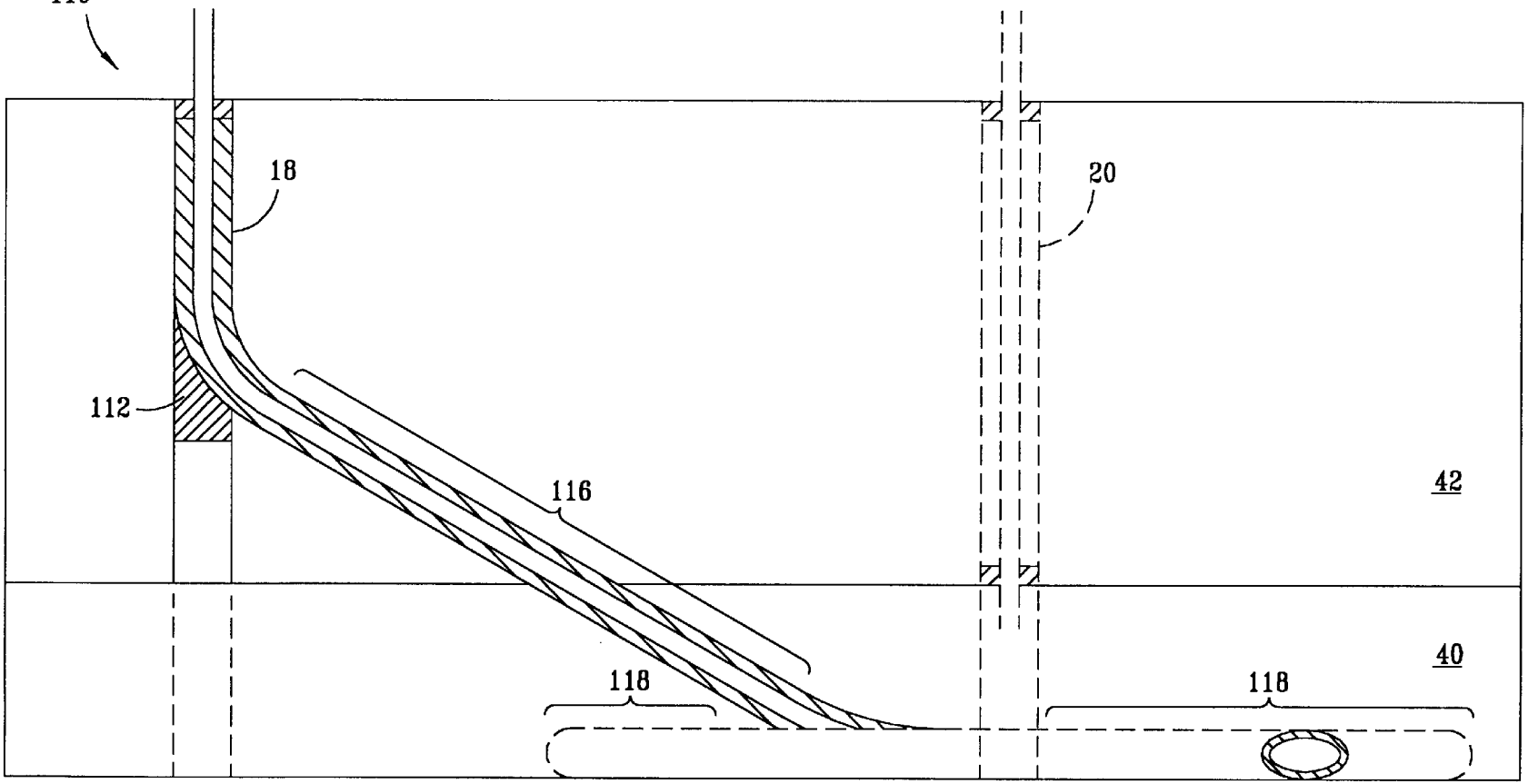
FIG. 5 is an elevation view of the array of wellbores of FIG. 4 taken along the line 5—5 of FIG. 4.

FIG. 5 shows an elevation view of the system 110 taken along the line 5—5 of FIG. 4. As shown therein, the system 110 includes the subterranean formation 40 and an overburden 42 which, as described above, are penetrated by the center wellbore 20 (shown in dashed outline), the perimeter wellbore 18 and, though not shown in FIG. 5, the perimeter wellbores 12, 14, 16, 22, 24, 26, and 28.

In accordance with the present invention, and as shown in FIGS. 4 and 5, a conventional whipstock 112 (FIG. 5) or sectioned casing and cement kick-off plug (not shown) is positioned in the wellbore 18. A horizontal wellbore 114 is sidetracked off of the wellbore 18 (which is subsequently used as an injection wellbore rather than a production wellbore) via the whipstock 112 or kick-off plug using a conventional drilling rig, coiled tubing, and a bit preferably turned by a mud motor. The horizontal wellbore 114 would preferably be cased, though it may optionally utilize a slotted liner, and it comprises a downwardly projecting portion 116, and a substantially horizontal, circular portion 118 (shown partially in dashed outline) which is positioned at the bottom of the formation 40 and which encircles the central wellbore 20 approximately halfway between the central wellbore 20 and the perimeter wellbores 12, 14, 16, 18, 22, 24, 26, and 28. As most clearly shown in FIG. 4, the downwardly projecting portion 116 of the horizontal wellbore 114 engages the horizontal, circular portion 118 slightly off a tangent of the circular portion 118 to permit a miscible injection of gas from the circular portion 118 to be directed to the wellbores 12, 14, 16, 22, 28, 26, and 24, as described below.

Figure 1:
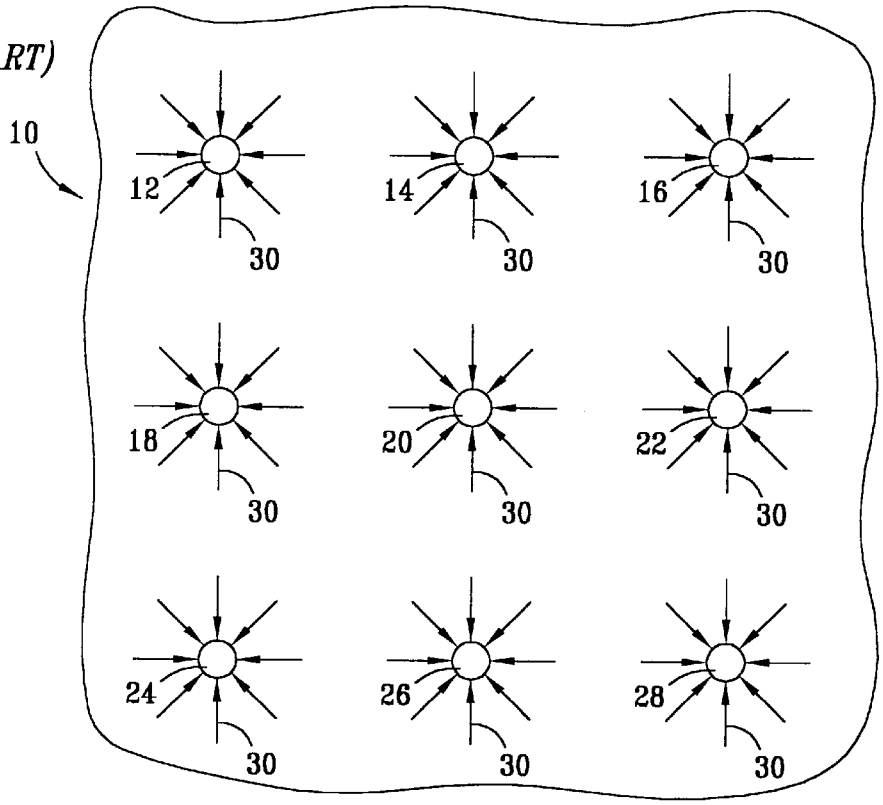
FIG. 1 (PRIOR ART)
FIG. 1 is a plan view of an array of wellbores configured according to the prior art for primary production.
Figure 2:
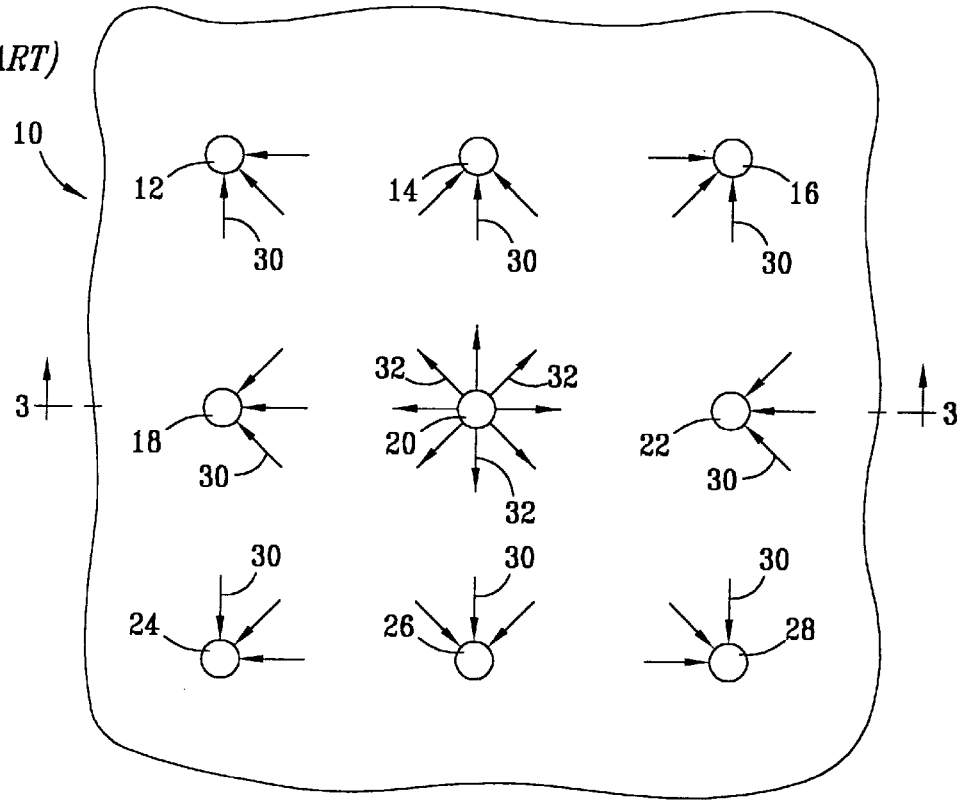
FIG. 2 (PRIOR ART)
FIG. 2 is a plan view of the array of wellbores of FIG. 1 configured for the enhanced recovery of additional oil according to the prior art.
Figure 3:
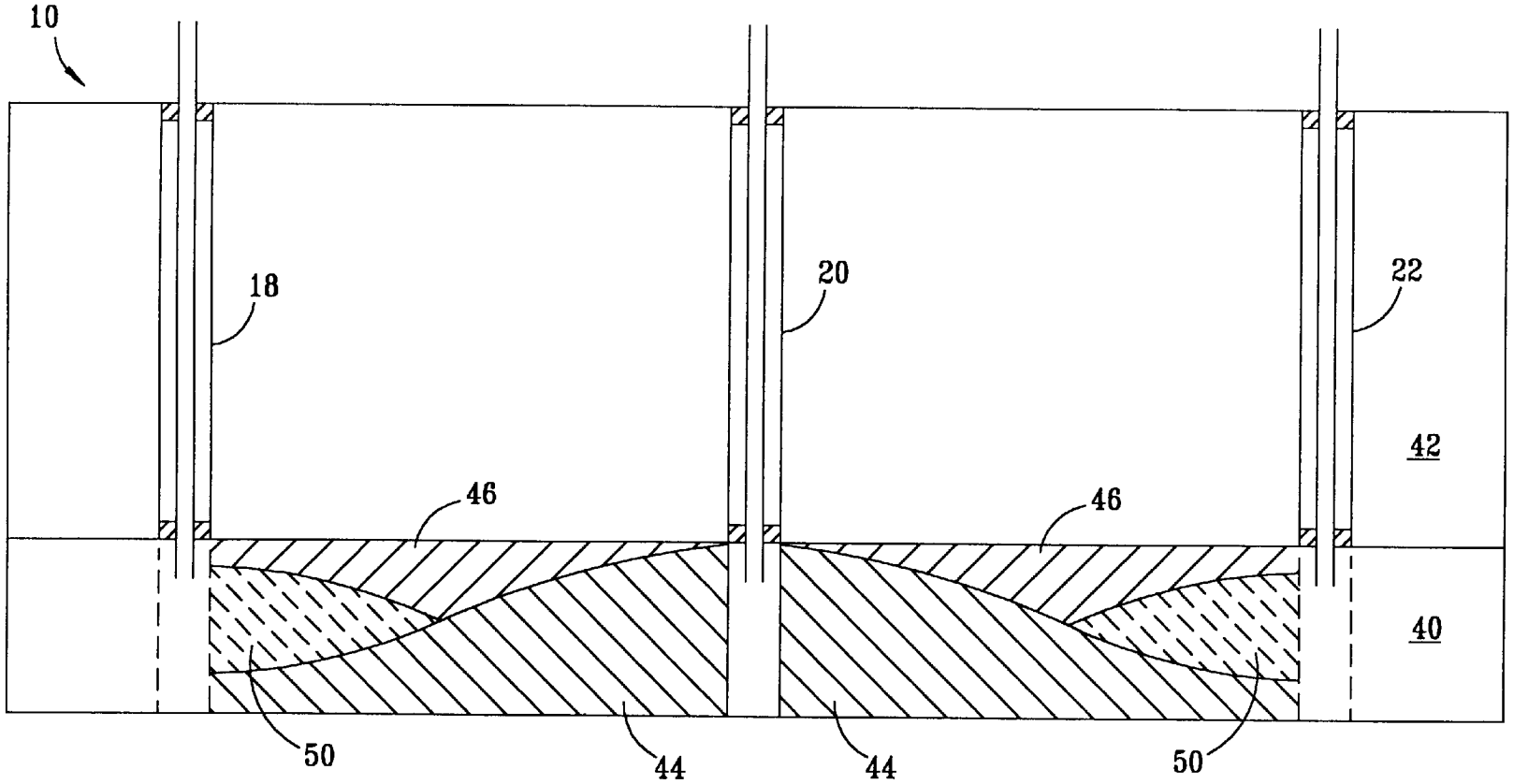
FIG. 3 (PRIOR ART)
FIG. 3 is an elevation view of the array of wellbores of FIG. 2 taken along the line 3—3 of FIG. 2.

In operation, and with reference to FIG. 3, water and a miscible gas are alternately injected via the central wellbore 20 into the formation 40. The water flows downwardly and outwardly from the central wellbore 20 through the flow path 44 in the formation 40 toward the perimeter wellbores 12, 14, 16, 18, 22, 24, 26, and 28. The gas flows upwardly and outwardly from the central wellbore 20 through the flow path 46 in the formation 40 toward the perimeter wellbores 12, 14, 16, 18, 22, 24, 26, and 28. Oil in the flow paths 44 and 46 will be swept into the perimeter wellbores 12, 14, 16, 22, 24, 26, and 28, but maximum oil recovery is not achieved.

Figure 6:
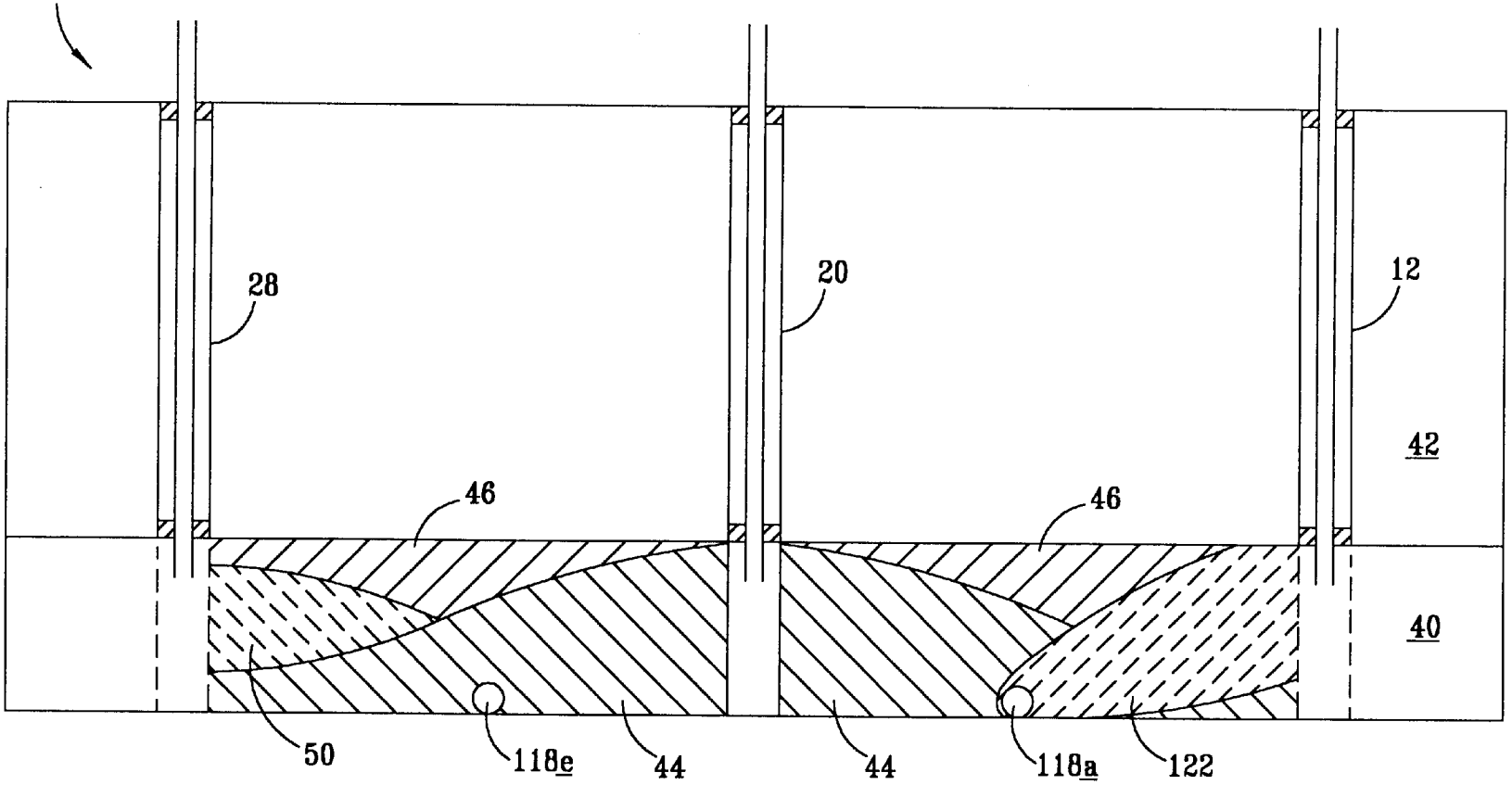
FIG. 6 is an elevation view of the array of wellbores of FIG. 4 taken along the line 6—6 of FIG. 4.

In accordance with the present invention, and with reference to FIG. 4, to improve the recovery of oil from the formation 40, an approximately 200 to 300 foot arcuate segment 118*a* of the horizontal, circular portion 118 of the horizontal circle wellbore 114 is perforated in a conventional manner. In conjunction with the continuous injection of water and gas into the formation 40 through the central wellbore 20, a miscible gas, such as a hydrocarbon selected from the group comprising one or more hydrocarbon gases containing from one to five carbon atoms, carbon dioxide, nitrogen, and the like, and mixtures thereof, alternating with water if desired, is injected into the horizontal circular wellbore 114. The miscible gas passes through the perforated portion 118*a* into the formation 40 and, as shown in FIG. 6, it migrates toward the perimeter wellbore 12, as indicated by the arrow 120*a* in FIG. 4 and the flow path 122 in FIG. 6. As the miscible gas migrates toward the wellbore 12, it passes through and sweeps oil in the region 50 associated with the perimeter wellbore 12 to the wellbore 12. The swept oil is then recovered through the wellbore 12 in a conventional manner either during or subsequent to the injection of water and/or gas from the central wellbore 20, and either during or subsequent to the injection of gas, alternating with water if desired, from the perforated portion 118*a*. When the region 50 associated with the wellbore 24 is substantially depleted of oil, the arcuate segment 118*a* is plugged off in a manner well known in the art.

The foregoing operation performed with respect to the segment 118*a* is then repeated for an additional 200 to 300 arcuate segment 118*b* spaced approximately 45° clockwise, as viewed in FIG. 4, from the segment 118*a*. Accordingly, in conjunction with the continuous injection of water and gas into the formation 40 through the central wellbore 20, the segment 118*b* is perforated, miscible gas, alternating with water if desired, is injected into the formation 40 as indicated by the dashed arrow 120*b* to recover additional oil via the wellbore 14 as described above with respect to the wellbore 12, and the segment 118*b* is plugged off. In a like manner, the forgoing operation is then sequentially repeated for arcuate segment 118*c*, 118*d*, 118*e*, 118*f*, and 118*g*, each of which are spaced approximately 45° apart, as depicted in FIG. 4, so that miscible gas, alternating with water if desired, is selectively injected into the formation 40 as indicated by the dashed arrows 120*c*, 120*d*, 120*e*, 120*f*, and 120*g*, respectively, to recover additional oil in the wells 16, 22, 28, 26, and 24, respectively.

Figure 7:
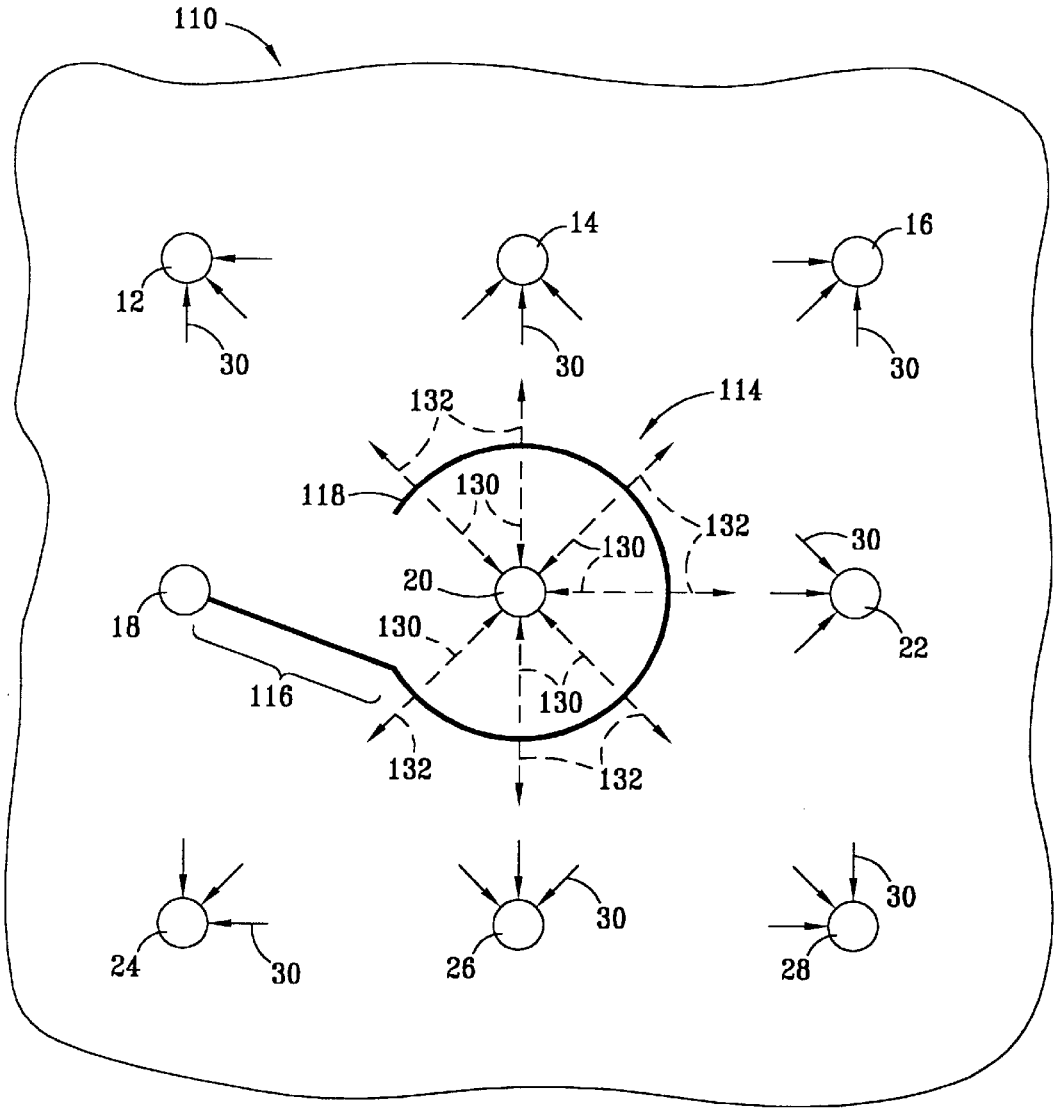
FIG. 7 is a plan view of the array of wellbores of FIG. 1 configured for recovering additional oil reserves according to an alternate embodiment of the present invention.

It is understood that the present invention can take many forms and embodiments. The embodiments described herein are intended to illustrate rather than to limit the invention. Accordingly, several variations may be made in the foregoing without departing from the spirit or the scope of the invention. For example, the horizontal circular wellbore 118 may be positioned at the top of the formation 40 and a water solution, such as brine or filtered seawater, instead of a miscible gas, may be injected therefrom to recover oil, or hydrocarbons generally, from the region 50 associated with each perimeter wellbore. Fluid injected into the formation 40 from the central wellbore 20 either could be a combination of water and gas, or could alternate between water and gas. In further variations, the horizontal circular wellbore 118 may comprise a slotted liner instead of casing which must be perforated. The entire length, instead of just segments, of the horizontal circular wellbore 118 may be used to inject fluid into the formation 40 toward all perimeter wellbores simultaneously. The segments 118*a*–118 *g* of the horizontal circular wellbore 118 may be perforated in any order, rather than in the order described above. In still further variations, the present invention may be implemented without the central wellbore 20 or, in accordance with a system 210 depicted in FIG. 7, the central wellbore 20 may be used as a producer wellbore instead of an injector wellbore. In the system 210, the horizontal circular wellbore 118 is utilized to inject fluid toward the central wellbore 20, as indicated by the arrows 130, as well as toward the perimeter wellbores 12, 14, 16, 22, 24, 26, and 28, as indicated by the arrows 132. Temporary isolation techniques may be utilized so that the segments 118*a*–118*g* may be accessed as desired after they have been plugged off.

The present invention has several advantages. For example, it provides for the recovery of oil which may not be recovered using only the central injector wellbore 20 know to the prior art. The present invention is also more efficient and effective than the prior art because the injected fluids are specifically placed in the formation where needed to sweep recoverable oil from the flow paths 44 and 46 and the region 50. Furthermore, the present invention is also more efficient and effective than the prior art because the pressure required to operate the present invention is much less than the pressure required by the prior art, for a number of reasons. First, the present invention concentrates pressure on the injected fluid through one arcuate segment of the horizontal circular wellbore at a time, instead of simultaneously applying pressure on injected fluid dispersed in all directions from a central injector wellbore, as taught in the prior art. Second, less pressure is required because the distance from the point of injection from the horizontal circular wellbore is approximately half the distance from the point of injection from a single injector wellbore, as taught in the prior art. Third, the probability of gas break-through at one well reducing the effectiveness of gas injection at other wells is decreased since gas is directed toward only one well at a time.

Although illustrative embodiments of the invention have been shown and described, a wide range of modifications, changes, and substitutions are contemplated in the forgoing disclosure and in some instances, some features of the present invention may be employed without a corresponding use of the other features. Accordingly, it is appropriate that the appended claims be construed broadly and in a manner consistent with the scope of the invention.

What is claimed is:

1. A method for increasing the recovery of oil from an oil-bearing subterranean formation having at least one producer wellbore drilled therein, comprising the steps of:

drilling a generally horizontal and generally circular wellbore into the formation so that oil is located between the generally horizontal and generally circular wellbore and the at least one producer wellbore;

injecting fluid through the generally horizontal and generally circular wellbore into the formation so that oil is swept toward the at least one producer wellbore; and producing the swept oil from the at least one producer wellbore, wherein at least a portion of the step of producing is performed during the step of injecting.

2. The method of claim 1 wherein the at least one producer wellbore comprises a plurality of wellbores arranged in a perimeter, and the step of drilling further comprises drilling the horizontal circular wellbore within the perimeter of the plurality of producer wellbores, and the method further comprises the steps of providing a central injector wellbore which is substantially encircled by the horizontal circular wellbore, and injecting fluid from the central injector wellbore toward the plurality of producer wellbores, and wherein the step of producing includes producing oil and the injected fluid from the plurality of producer wellbores.

3. The method of claim 2 further comprising locating the horizontal circular wellbore from about one fourth to about three fourths of the way, and preferably about halfway, between the central injector wellbore and the plurality of producer wellbores.

4. The method of claim 2 wherein at least a portion of each of the steps of injecting fluid through the generally horizontal and generally circular wellbore, of injecting fluid from the central injector wellbore, and of producing are performed concurrently.

5. The method of claim 1 wherein the at least one producer wellbore includes a plurality of wellbores arranged in a perimeter, and the step of drilling further comprises drilling the generally horizontal and generally circular wellbore within the perimeter of the plurality of producer wellbores, and the method further comprises the steps of providing a central producer wellbore, and of injecting fluid from the generally horizontal and generally circular wellbore toward the central producer wellbore and the plurality of producer wellbores, and wherein the step of producing includes producing the oil and injected fluids from the central producer wellbore and the plurality of producer wellbores.

6. The method of claim 5 further comprising locating the generally horizontal and generally circular wellbore approximately halfway between the central producer wellbore and the plurality of producer wellbores.

7. The method of claim 5 wherein at least a portion of each of the steps of injecting fluid through the generally horizontal and generally circular wellbore, and of producing are performed concurrently.

8. The method of claim 1 wherein the fluid is selected from the group of fluids consisting of water, a gas, and a miscible gas, wherein the miscible gas is selected from the group consisting of hydrocarbons containing from one to about five carbon atoms, carbon dioxide, nitrogen, and mixtures thereof.

9. The method of claim 1 wherein the step of injecting comprises injecting a combination of fluids through the generally horizontal and generally circular wellbore into the formation so that oil is swept toward the at least one producer wellbore, wherein the fluids are selected from the group of fluids consisting of water, a gas, and a miscible gas, wherein the miscible gas is selected from the group consisting of hydrocarbons containing from one to about five carbon atoms, carbon dioxide, nitrogen, and mixtures thereof.

10. The method of claim 1 wherein the step of injecting comprises injecting water and a gas in alternating injection cycles through the generally horizontal and generally circular wellbore into the formation so that oil is swept toward the at least one producer wellbore.

11. The method of claim 1 wherein the step of drilling further comprises the steps of selecting a wellbore to be an injection wellbore, sidetracking out of the selected wellbore, and drilling the generally horizontal and generally circular wellbore from the sidetracked wellbore.

12. The method of claim 1 wherein the generally horizontal and generally circular wellbore comprises a slotted liner.

13. The method of claim 1 wherein the generally horizontal and generally circular wellbore comprises coiled tubing and the method further comprises the step of perforating the coiled tubing.

14. The method of claim 1 wherein the generally horizontal and generally circular wellbore comprises casing and the step of injecting further comprises the steps of perforating a first arcuate segment of the generally horizontal and generally circular wellbore, selectively injecting fluid through the perforated first segment into the formation so that oil is swept to a first selected producer wellbore, plugging the perforated first segment, and repeating the steps of perforating, selectively injecting, and plugging for additional arcuate segments of the generally horizontal and generally circular wellbore so that oil is swept to additional selected producer wellbores.

15. The method of claim 14 wherein the step of plugging comprises temporarily isolating the perforated first segment so that the segment may be accessed at a subsequent time.

16. The method of claim 14 wherein the first and additional arcuate segments are spaced approximately 45° apart.

17. The method of claim 1 wherein the generally circular portion of the generally horizontal and generally circular wellbore is located approximately at the bottom of the subterranean formation.

18. The method of claim 1 wherein the step of producing is substantially performed during the step of injecting.

19. The method of claim 1 wherein the step of producing is performed using a different wellbore than is used in the step of injecting.

20. The method of claim 1 wherein, during the step of injecting, oil is swept generally horizontally toward the at least one producer wellbore.

* * * * *